US006814428B2

(12) United States Patent
Huang et al.

(10) Patent No.: US 6,814,428 B2
(45) Date of Patent: Nov. 9, 2004

(54) FLUID INJECTION HEAD STRUCTURE AND METHOD THEREOF

(75) Inventors: Tsung-Wei Huang, Taipei (TW); Chih-Ching Chen, Taipei (TW)

(73) Assignee: BenQ Corporation, Tao-Yuan Hsien (TW)

( * ) Notice: Subject to any disclaimer, the term of this patent is extended or adjusted under 35 U.S.C. 154(b) by 69 days.

(21) Appl. No.: 10/249,285

(22) Filed: Mar. 28, 2003

(65) Prior Publication Data

US 2004/0085406 A1 May 6, 2004

Related U.S. Application Data

(62) Division of application No. 10/065,588, filed on Oct. 31, 2002.

(30) Foreign Application Priority Data

Nov. 8, 2001 (TW) ..... 90127721 A

(51) Int. Cl.[7] ..... B41J 2/14; B41J 2/16; B41J 2/05

(52) U.S. Cl. ..... 347/50; 347/48; 347/59

(58) Field of Search ..... 348/48, 50, 58, 348/53

(56) References Cited

U.S. PATENT DOCUMENTS

| | | | | |
|---|---|---|---|---|
| 5,122,812 A | | 6/1992 | Hess et al. | |
| 5,774,148 A | | 6/1998 | Cornell et al. | |
| 6,039,438 A | | 3/2000 | Beerling | |
| 6,081,280 A | * | 6/2000 | Bolash et al. | 347/9 |
| 6,102,528 A | * | 8/2000 | Burke et al. | 347/59 |
| 6,102,530 A | | 8/2000 | Kim et al. | |

* cited by examiner

*Primary Examiner*—Michael S. Brooke
(74) *Attorney, Agent, or Firm*—Winston Hsu

(57) ABSTRACT

A method for manufacturing a fluid injection head. The fluid injection head structure is formed on a substrate and has a manifold therein, bubble generators, a conductive trace, and at least two rows of chambers adjacent to the manifold in flow communication with the manifold. The conductive trace disposed on a top surface of the substrate and partially disposed between the two rows of the chambers above the manifold is used to drive the bubble generator.

16 Claims, 8 Drawing Sheets

FLUID INJECTION HEAD STRUCTURE AND METHOD THEREOF

CROSS REFERENCE TO RELATED APPLICATIONS

This application is a division of U.S. application Ser. No. 10/065,588 filed Oct. 31, 2002.

BACKGROUND OF INVENTION

1. Field of the Invention

The present invention relates to a fluid injection head structure and a method of fabricating the same, and more particularly, to a fluid injection head structure with a power line disposed between two rows of bubble generators and a method of fabricating the same.

2. Description of the Prior Art

Currently, fluid injection devices are widely applied in ink jet printers. Improvements in fluid injection devices are resulting in ink jets that are of higher quality, are more reliable, and less expensive to manufacture. Fluid injection devices can also be applied to many other fields, such as fuel Injection systems, cell sorting, drug delivery systems, print lithography, and micro jet propulsion systems.

Among the products available on the market, only a few can eject individual droplets in uniform shapes. One of the most successful designs uses thermal driven bubbles to eject droplets. This design is widely used due to Its ease of manufacture and low cost. U.S. Pat. No. 5,774,148, "Print head with field oxide as thermal barrier in chip", details a method of center feeding in a fluid injection head. To fabricate this kind of jet structure, a sand blasting, laser drilling, or chemical etching process must be performed to create a hole in the center of the chip for the Ink to feed through.

However, this method requires a larger chip size because the removed area of the chip is wasted, which results in less cost-efficiently manufacturing.

SUMMARY OF INVENTION

It is therefore a primary objective of the claimed invention to provide a fluid injection head structure with increased layout integration to shrink the chip size and lower the costs of manufacture.

In a preferred embodiment of the claimed invention, the fluid injection head structure comprises a substrate, a manifold formed inside the substrate, at least two rows of chambers formed on two sides of the manifold and connected to the manifold, at least one bubble generator, and a conductive trace disposed on a top surface of the substrate. In addition, a portion of the conductive trace is disposed between the two rows of chambers. The conductive trace is used to drive the bubble generators.

It is an advantage of the present invention that ink is fed successfully without fully etching through the chips, making more space available. The area above the manifold may be used for electric circuit layouts. This not only reinforces the strength of the structure of the layers above the manifold, but also shrinks the chip size. Moreover, as chip size shrinks, the number of injection heads in the same area increases and, therefore, printing speed is improved.

These and other objectives of the claimed invention will not doubt become obvious to those of ordinary skill in the art after reading the following detailed description of the preferred embodiment, which is illustrated in the various figures and drawings.

DETAILED DESCRIPTION

Figure 1:
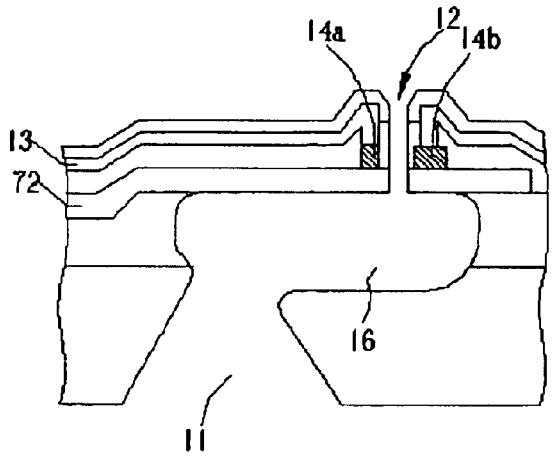
FIG. 1 is a cross-sectional diagram of a print head structure according to the present invention.

Please refer to FIG. 1, which is a cross-sectional diagram of a print head structure according to the present invention. The print head structure of the present invention is a fluid injection head structure with virtual valves. As shown in FIG. 1, a bubble generator 14 comprises two bubble generating devoces, a first heater 14*a* and a second heater 14*b*, disposed adjacent to an orifice 12. Because of differences, such as different resistances, between the two heaters 14*a* and 14*b*, when the two heaters 14*a* and 14*b* heat fluid, (not shown) inside the chamber 16, two bubbles are generated in turn. A first bubble (not shown) is generated by the first heater 14*a*, which is closer to a manifold 11 than the second heater 14*b*. The first bubble isolates the manifold 11 from the orifice 12 and acts as a virtual valve to reduce a cross talk effect between this chamber 16 and neighboring chambers 16. A second bubble (not shown) is generated by the second heater 14*b*. The second bubble squeezes fluid, such as ink, inside the chamber 16 to eject out of the orifice 12. Finally, the second bubble combines with the first bubble to reduce the generation of satellite droplets.

The fluid injection head structure of the present invention feeds ink successfully without fully etching through the chips. Based on this structure, power line layouts can be designed above the manifold 11 so as to reinforce the strength of the structure layer above the manifold 11.

Figure 2:
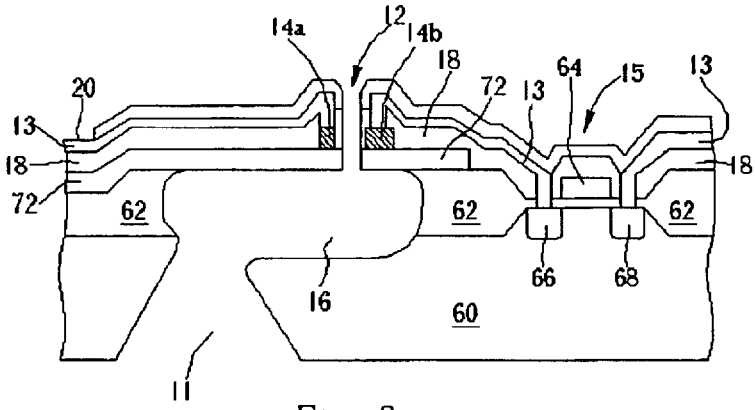
FIG. 2 is a cross-sectional diagram of a fluid injection head structure according to the present invention.

Please refer to FIG. 2, which shows a cross-sectional diagram of a fluid injection head structure according to the present invention. A low temperature oxide layer 18 is deposited onto the first heater 14*a* and the second heater 14*b* as a protective layer. After that, a via layer is formed in a predetermined area and then a metal layer 13 is deposited on the top surface of the heaters 14*a* and 14*b* through the via layer. Thus, the metal layer 13 is electrically connected to the heaters 14*a* and 14*b*.

In the same manner, a drain 68 and a source 66 of a MOSFET 15 are electrically connected to the heaters 14*a* and 14*b*, and a ground 20 via the metal layer 13. Thus, when a gate 64 of the MOSFET 15 is turned on, an external voltage signal is applied to the print head from a pad made of the metal layer 13. At this time, a current flows from the pad via the metal layer 13 to the first heater 14*a* and the second heater 14*b*. Then, the current passes through the drain 68 and the source 66 of the MOSFET 15 to the ground 20 so as to complete a heating action. As the ink inside the chamber 16 is heated, two bubbles are generated to squeeze ink droplets out of the orifice 12. It dependents upon the data to be printed to control which orifice 12 ejects ink droplets during a printing process. The material of the metal layer 13 can be any one of aluminum, gold, copper, tungsten, or alloys of aluminum-silicon-copper, or alloys of aluminum-copper.

Figure 3:
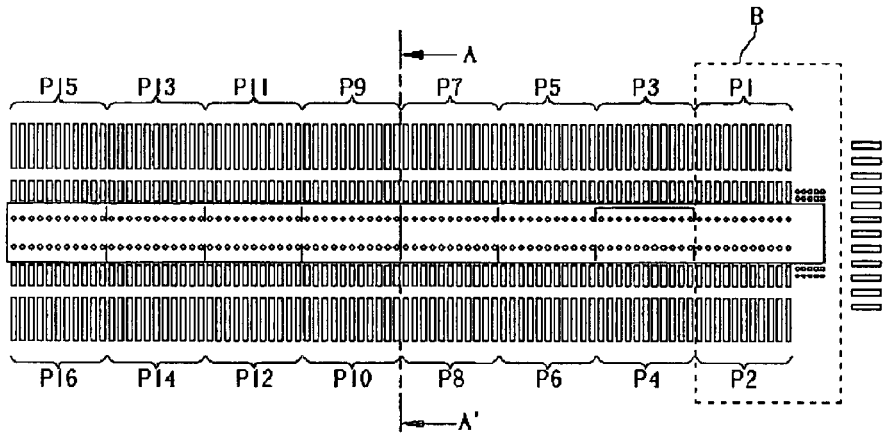
FIG. 3 is a top view of the fluid injection head structure according to the present invention.
Figure 4:
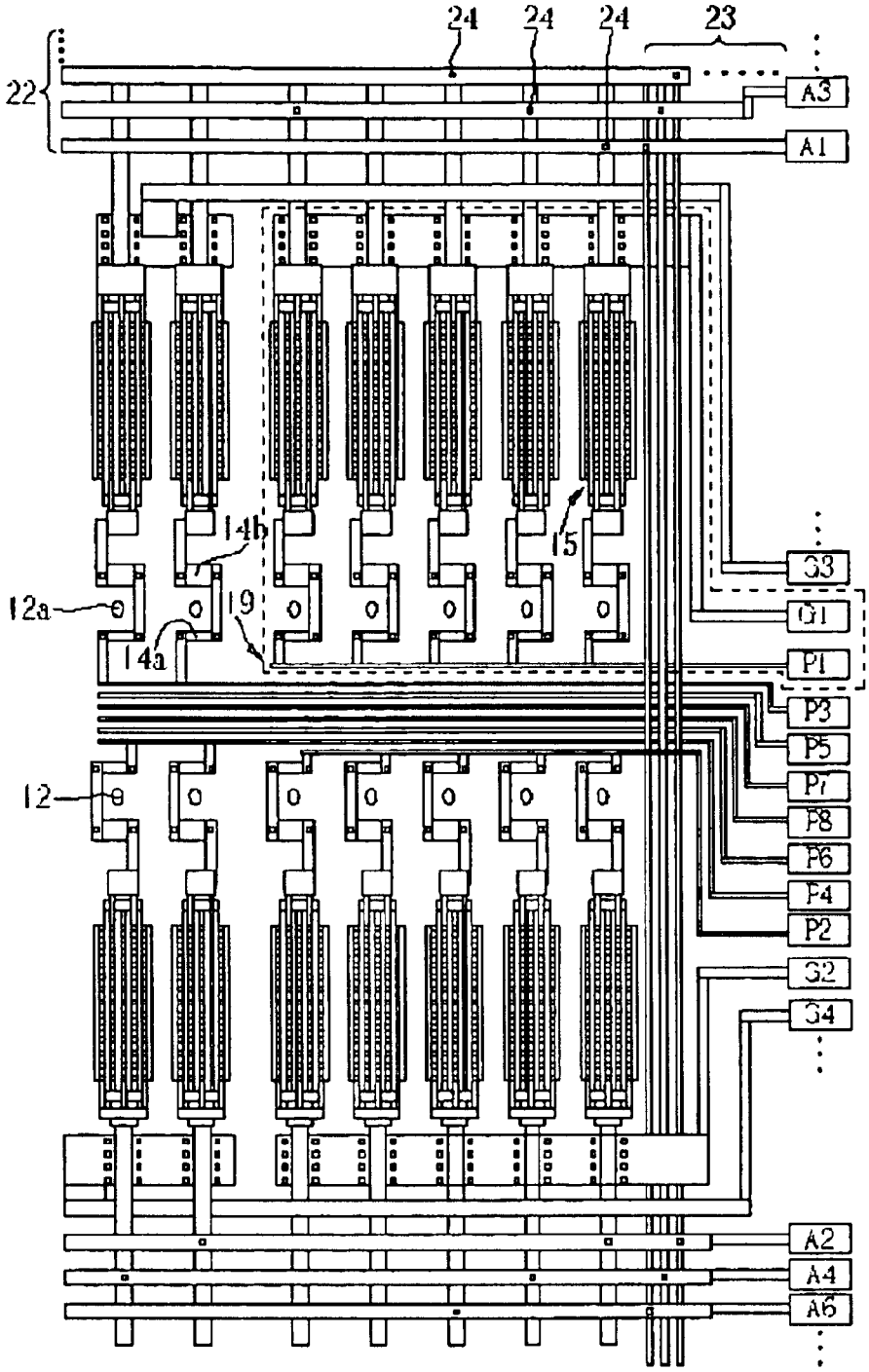
FIG. 4 is a local amplified diagram of the fluid injection head shown in FIG. 3.
Figure 5:
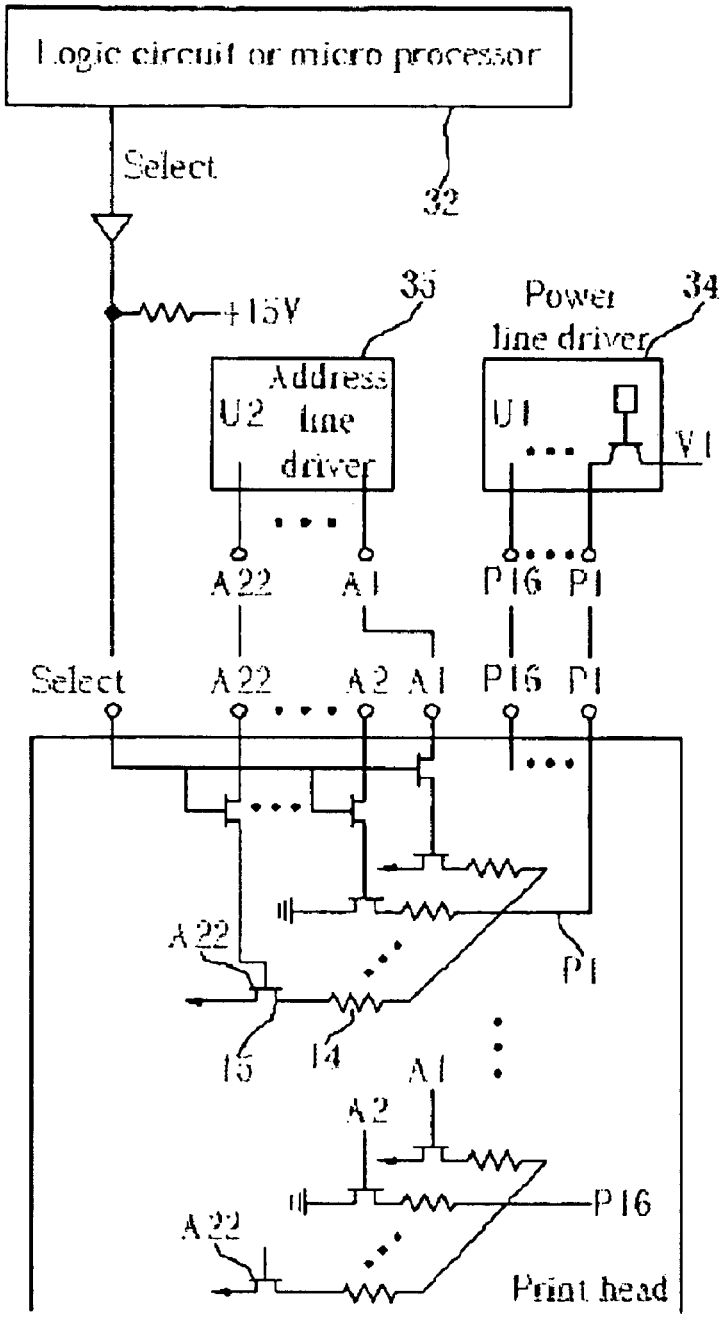
FIG. 5 is a schematic diagram of a matrix driving circuit in the fluid injection head according to the present invention.

Please refer to FIG. 3 and FIG. 4. FIG. 3 is a top view of the print head according to the present invention. In the preferred embodiment, the orifices 12 of the print head is divided into sixteen P groups, P1 to P16, and each P group comprises twenty-two addresses, A1 to A22. As shown in FIG. 5, which shows a schematic diagram of a matrix driving circuit, a select signal is generated by a logic circuit or microprocessor 32 according to the data to be printed. Then, the select signal is transmitted to a power drive 34 and an address driver 35 to determine which A (A1 to A22) should be turned on and to which P (P1 to P16) the power should be provided. For example, when providing power to P1 and turning on A22, the heaters 14*a* and 14*b* on the MOSFET 15 of P1-A22 will complete an operation of heating and ejecting ink at the predetermined time.

FIG. 4 is a local amplified diagram of the region B shown in FIG. 3. As shown in FIG. 4, two rows of orifices 12, 12*a* are positioned on the center of the chip. When dividing the orifices into two parts by the line A—A", as shown in FIG. 3, there are eight groups on the right side, P1 to P8, and eight groups on the left side, P9 to P16. The area above the manifold 11 between the two rows of orifices 12, 12*a* is used for a power line layout. Eight metal power lines corresponding to P1 to P8 are positioned to the right of line A—A" and are electrically connected to I/O pads on the right. Eight power lines corresponding to P9 to P16 (not shown) are positioned to the left of line A—A" and are electrically connected to I/O pads on the left.

The driving circuit between each corresponding P pad and G pad uses a U-type circuit layout. The driving circuit between the pad P1 and the pad G1 is illustrated in a doshed block in FIG. 4. Each driving circuit is connected without crossing any other driving circuit. Only one metal layer 13 is used to form the power line 19 between the heaters 14*a*, 14*b* and the grounding pad G. There are eleven metal lines 22 positioned above the group of MOSFET 15 and another eleven metal lines 22 positioned below the groups of MOSFFT 15 in the FIG. 4. The metal lines 22 are electrically connected to the pads A so as to transmit the output data of the address driver 35 to the corresponding groups of MOSFET 15 to control ink ejection. There are also eleven poly-silicon lines 23 positioned to the left of the groups of MOSFET 15 and another eleven to the right of the MOSFET 15. Then, contact layers 24 are formed to electrically connect the metal lines 22 and the poly-silicon lines 23 to complete the connection of the driving circuits. The poly-silicon lines 23 are used to connect themetal lines 22 above and below the groups of MOSFET 15 (i.e. the upper parts and lower parts of the metal lines 22 in the FIG. 4). For example, if a signal is input from the pad A1 to turn on the heaters of P16, it has to be transmitted via the poly-silicon lines 23 through the metal lines 22 to the heaters of P16.

Figure 6:
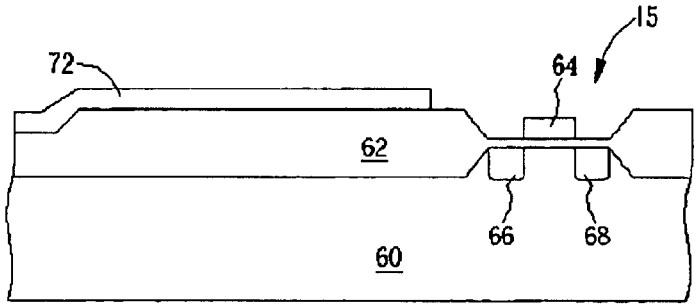
FIG. 6 to FIG. 8 are schematic diagrams of forming the fluid injection head according to the present invention.
Figure 7:
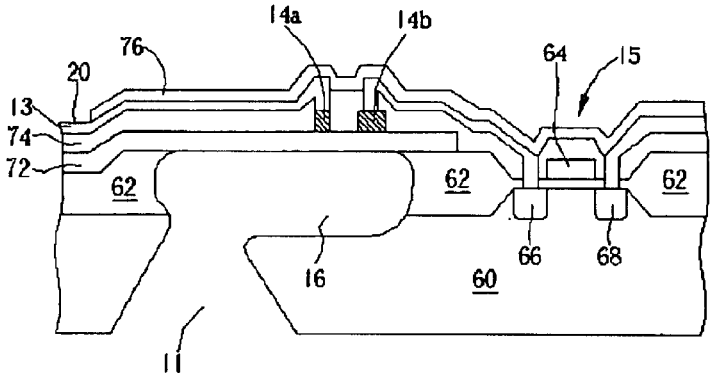
Figure 8:
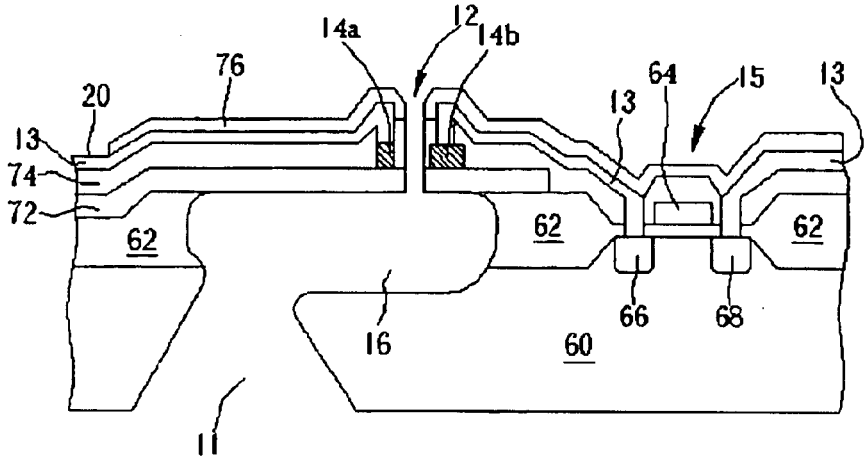

Please refer to FIG. 6 to FIG. 8, which show schematic diagrams of forming the fluid injection head according to the present invention. First, a local oxidation process is performed to form a field oxide layer 62 on a silicon substrate 60. Then a blanket boron implantation process is performed to adjust the threshold voltage of the driving circuit. A poly-silicon gate 64 is formed in the field oxide layer 62. At the same time, twenty-two poly-silicon lines 23 are formed along two edges of the chip. An arsenic implantation is performed to form a source 66 and a drain 68 on both sides of the gate 64. Then a low stress layer 72 such as silicon nitride is deposited to form an upper layer of the chamber 16 as shown in FIG. 6.

Please refer to FIG. 7. An etching solution (KOH) is used to etch a back side of substrate 60 to form a manifold 11 for fluid supply. Then them field oxide layer 62 is partially removed with an etching solution (HF) to form the chamber 16. After that, a precisely-timed etching process using KOH is performed to increase the depth of the chamber 16. The chamber 16 and the manifold in are connected and filled with fluid, however this etching process needs special attention because convex corners in the chamber 16 are also etched.

Next, a process of forming heaters is performed. This process should be obvious to those of ordinary skill in the art. A good choice of materials to use for the first heater 14*a* and the second heater 14*b* is alloys of tantalum and aluminum, but other materials like platinum or $HfB_2$ can also work effectively. A low temperature oxide layer 74 is deposited over the entire substrate 60. In addition to protecting the first heater 14*a* and the second heater 14*b* and isolating the MOSFET 15, the low temperature oxide layer 74 serves as a protective layer that covers the gate 64, the source 66, the drain 68, and the field oxide 62.

Next, a conductive layer 13 is formed on the first heater 14*a* and the second heater 4*b* to electrically connect the first heater 14*a*, the second heater 14*b*, and the MOSFET 15 of the driving circuit. The driving circuit transmits a signal to individual heaters and drives a plurality of pairs of heaters, so that fewer circuit devices and linking circuits are required. The preferred material for the conductive layer 13 is an alloy of aluminum-silicon-copper, aluminum, copper, gold, or tungsten. A low temperature oxide layer 76 is deposited as a protection layer on the conductive layer Please refer to FIG. 8. An orifice 12 is formed between the first heater 14*a* and the second heater 14*b*. So far, the specification has detailed the formation of a fluid injector array with a driving circuit integrated in one piece. The driving circuit and heaters are integrated on the same substrate and an integrated injection head structure is formed without the need for an attached nozzle plate.

The following is a detailed description of the operation of the present invention. Please refer to FIG. 4 and FIG. 5. When printing starts, the logic circuit or microprocessor 32 determines which orifices 12 should eject ink according to the data to be printed and generates a select signal. The select signal is transmitted to the power driver 34 and the address driver 32 to turn on the proper A groups (A1 to A22) and apply power to the proper P groups (P1 to P16). Thus, a current is generated and applied to the heaters 14*a* and 14*b* to heat fluid and generate bubbles so that ink droplets are ejected. For example, suppose that a droplet is to be ejected from the orifice 12*a* of A1–P1. First, a voltage signal is input from an I/O pad of A1 and transmitted to the gate 64 of MOSFET 15 to turn on the gate 64. Next, another voltage signal is input from an I/O pad of P1 to generate a current. The current passes via the heaters 14*a* and 14*b* to the drain 68, the source 66, and the ground 20 so as to heat the fluid and generate bubbles. The bubbles act to eject an ink droplet from the orifice 12*a* of A1–P1.

Although the above description details monochromatic printers, the present invention can be applied to color printers or multi-color printers. In addition, the present invention also can be applied to other fields, such as fuel injection systems, cell sorting, drug delivery systems, print lithography, micro inject propulsion systems, and others.

According to the present invention, the space above manifolds and between two rows of chambers is available for layouts of conductive trace. There are several advantages of the present invention. Since the print head is manufactured without etching through the entire chip, the circuit layouts can be performed above the manifolds, leading to a reduction in wafer size and a consequent increase in the number of dies per wafer. The placement of the circuit layouts on the structure layer above the manifold reinforces the strength of the structure layer. Using this method of improving the density of circuit layout, the area required for circuit layout is reduced, and more orifices can be disposed in the same wafer area to improve the printing speed.

Those skilled in the art will readily observe that numerous modifications and alterations of the invention may be made while retaining the teachings of the invention. Accordingly, the above disclosure should be construed as limited only by the metes and bounds of appended claims.

What is claimed is:

1. A print head comprising:

a plurality of orifices formed on the print head for ejecting ink from the print head;

a plurality of bubble generators corresponding to the orifices for generating bubbles in the ink and ejecting the ink through the corresponding orifices;

a plurality of transistors, wherein a transistor is electrically connected to a respective bubble generator for switching the bubble generator on and off;

a plurality of power pads for providing power to one end of a group of bubble generators;

a plurality of address pads, the address pads corresponding to each of the bubble generators for selecting one of the bubble generators in the group of bubble generators; and a plurality of ground pads for providing a ground connection to another end of the group of bubble generators, sets of adjacent ground pads being formed between the power pads and the address pads.

2. The print head of claim 1 wherein each of the power pads and ground pads are electrically connected through metal lines formed in the print head.

3. The print head of claim 1 wherein each of the power pads, address pads, and ground pads are electrically connected to metal lines formed in the print head.

4. The print head of claim 3 wherein each of the bubble generators and corresponding transistors are electrically connected to poly-silicon lines formed in the print head.

5. The print head of claim 4 wherein the metal lines electrically connected to the address pads are connected through via connectors to the poly-silicon lines electrically connected to the bubble generators and corresponding transistors.

6. The print head of claim 3 wherein paths formed by the power pads, the metal lines electrically connected to the power pads, the bubble generators, the corresponding transistors, the metal lines electrically connected to the ground pads, and the ground pads have roughly a U-shaped pathway.

7. The print head of claim 1 wherein the bubble generators comprise heaters for heating the ink and causing bubbles to form in the ink.

8. The print head of claim 1 wherein the transistors corresponding to the bubble generators are MOS transistors with a poly-silicon gate.

9. The print head of claim 1 wherein a set of adjacent power pads are formed at a center of one side of the print head and the sets of adjacent ground pads are formed on either side of the set of adjacent power pads.

10. The print head of claim 9 wherein sets of adjacent address pads are formed on each outer side of the sets of adjacent ground pads.

11. The print head of claim 10 wherein the power pads, ground pads, and address pads are formed on opposite sides of the printhead, with the plurality of orifices being formed in between.

12. A print head comprising:

a plurality of orifices formed on the print head for ejecting ink from the print head;

a plurality of bubble generators corresponding to the orifices for generating bubbles in the ink and ejecting the ink through the corresponding orifices;

a plurality of transistors, wherein a transistor is electrically connected to a respective bubble generator for switching the bubble generator on and off;

a plurality of power pads for providing power to one end of a group of bubble generators;

a plurality of address pads, the address pads corresponding to each of the bubble generators for selecting one of the bubble generators in the group of bubble generators; and a plurality of ground pads for providing a ground connection to another end of the group of bubble generators, wherein a set of adjacent power pads are formed at a center of one side of the print head and sets of adjacent ground pads are formed on either side of the set of adjacent power pads.

13. The print head of claim 12 wherein sets of adjacent address pads are formed on each outer side of the sets of adjacent ground pads.

14. The print head of claim 13 wherein the power pads, ground pads, and address pads are formed on opposite sides of the printhead, with the plurality of orifices being formed in between.

15. A print head comprising:

a plurality of orifices formed on the print head for ejecting ink from the print head;

a plurality of bubble generators corresponding to the orifices for generating bubbles in the ink and ejecting the ink through the corresponding orifices;

a plurality of transistors, wherein a transistor is electrically connected to a respective bubble generator for switching the bubble generator on and off;

a plurality of power pads for providing power to one end of a group of bubble generators;

a plurality of address pads, the address pads corresponding to each of the bubble generators for selecting one of the bubble generators in the group of bubble generators; and a plurality of ground pads for providing a ground connection to another end of the group of bubble generators, wherein paths formed by the power pads, metal lines electrically connected to the power pads, the transistors, metal lines electrically connected to the ground pads, and the ground pads have roughly a U-shaped pathway, wherein sets of adjacent ground pads are formed between the power pads and the address pads.

16. The print head of claim 15 wherein each of the power pads and ground pads are electrically connected through metal lines formed in the print head.

* * * * *